US010443342B2

(12) United States Patent
Eidem et al.

(10) Patent No.: US 10,443,342 B2
(45) Date of Patent: Oct. 15, 2019

(54) METHOD AND APPARATUS FOR SEALING AN ANNULUS AROUND A DRILL-PIPE WHEN DRILLING DOWN-HOLE

(71) Applicant: STATOIL PETROLEUM AS, Stavanger (NO)

(72) Inventors: Morten Eidem, Trondheim (NO); Rune Haugom, Nesttun (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/575,492

(22) PCT Filed: May 20, 2016

(86) PCT No.: PCT/NO2016/050099
§ 371 (c)(1),
(2) Date: Nov. 20, 2017

(87) PCT Pub. No.: WO2016/186519
PCT Pub. Date: Nov. 24, 2016

(65) Prior Publication Data

US 2018/0163502 A1 Jun. 14, 2018

(30) Foreign Application Priority Data

May 20, 2015 (GB) ..... 1508619.2

(51) Int. Cl.
*E21B 21/10* (2006.01)
*E21B 23/06* (2006.01)
(Continued)

(52) U.S. Cl.
CPC ..... *E21B 33/127* (2013.01); *E21B 21/10* (2013.01); *E21B 23/06* (2013.01); *E21B 34/14* (2013.01)

(58) Field of Classification Search
CPC ..... E21B 33/12; E21B 21/10; E21B 23/06; E21B 34/14
See application file for complete search history.

(56) References Cited

U.S. PATENT DOCUMENTS 2,862,562 A 12/1958 Hughes
3,503,445 A 3/1970 Cochrum et al.
(Continued)

FOREIGN PATENT DOCUMENTS

EP 0 819 830 A2 1/1998
GB 2 219 615 A 12/1989
(Continued)

OTHER PUBLICATIONS

International Search Report, issued in PCT/NO2016/050099, dated Aug. 1, 2016.
(Continued)

*Primary Examiner* — Giovanna C Wright
*Assistant Examiner* — Yanick A Akaragwe
(74) *Attorney, Agent, or Firm* — Birch, Stewart, Kolasch & Birch, LLP

(57) ABSTRACT

A method of sealing an annulus around a drill-pipe when drilling down-hole includes providing a deflated packer on a drill-pipe when drilling down-hole; opening one or more ports to the packer using a ball-activated valve; and circulating drilling fluid to inflate said packer through said one or more ports, to thereby form a seal in the annulus around the drill-pipe. An apparatus to carry out this method is also provided.

20 Claims, 2 Drawing Sheets

(51) Int. Cl.
*E21B 33/127* (2006.01)
*E21B 34/14* (2006.01)

(56) References Cited

U.S. PATENT DOCUMENTS

| | | | | |
|---|---|---|---|---|
| 4,889,199 | A | 12/1989 | Lee | |
| 4,941,534 | A | 7/1990 | Berzin | |
| 5,109,925 | A | 5/1992 | Stepp et al. | |
| 5,375,662 | A | 12/1994 | Echols, III et al. | |
| 5,488,994 | A | 2/1996 | Laurel et al. | |
| 2005/0011678 | A1 | 1/2005 | Akinlade et al. | |
| 2010/0294512 | A1* | 11/2010 | Assal | E21B 7/061 166/384 |
| 2010/0314126 | A1 | 12/2010 | Kellner | |
| 2016/0258280 | A1* | 9/2016 | Murphree | E21B 47/12 |

FOREIGN PATENT DOCUMENTS

| | | | |
|---|---|---|---|
| GB | 2 309 722 | A | 6/1997 |
| WO | WO 2011/060493 | A1 | 5/2011 |

OTHER PUBLICATIONS

United Kingdom Combined Search and Examination Report, issued in Priority Application No. 1508619.2, dated Jul. 24, 2015.
United Kingdom Further Search Report, issued in Priority Application No. 1508619.2, dated Jan. 28, 2016.
Written Opinion of the International Searching Authority, issued in PCT/N02016/050099, dated Aug. 1, 2016.

* cited by examiner

METHOD AND APPARATUS FOR SEALING AN ANNULUS AROUND A DRILL-PIPE WHEN DRILLING DOWN-HOLE

FIELD OF THE INVENTION

The present invention relates to a method and apparatus for sealing an annulus around a drill-pipe when drilling down-hole, both in cased and open hole.

BACKGROUND TO THE INVENTION

At the time of writing there are no commercially available tools to allow a drilled well to be fully or partially sealed in open-hole, while drilling, without use of complex electronics, battery-operated devices or wired pipe.

X Drilling Tools produce a tool known as LossMaster™ that comprises a drill-string anchor and packer for sealing between the drill-string and casing but not in open-hole. The tool uses ball-activated slips to anchor the tool to the casing and then uses weight to expand the packer.

Furthermore, external casing packers (ECPs), which expand when filled with cement, are known for isolating zones between a casing and a wellbore during production but not when drilling.

Traditional techniques also do not permit communication with tools/sensors both above and below the seal when set.

It is therefore an aim of the present invention to provide to a method and apparatus for sealing an annulus around a drill-pipe when drilling down-hole, which helps to address the afore-mentioned problems, even if placed above a Measurement While Drilling (MWD) pulser and/or turbine which can provide a pressure measurement from below the packer/sealing element.

SUMMARY OF THE INVENTION

In accordance with a first aspect of the present invention there is provided a method of sealing an annulus around a drill-pipe when drilling down-hole comprising:

- providing a deflated packer on a drill-pipe when drilling down-hole;
- opening one or more ports to said packer using a ball-activated valve; and
- circulating drilling fluid to inflate said packer through said one or more ports, to thereby form a seal in the annulus around the drill-pipe.

Embodiments of the invention therefore provide a simple and cheap method for sealing an annulus around a drill-pipe when drilling down-hole. The method can be used to quickly solve issues when they arise, for example, due to massive losses, influx (i.e. kick) or cross-flow between two well segments. In particular, the method can be used to dramatically improve a well-control situation when drilling in areas with a narrow operational window.

In effect, the method can be used to quickly and easily deploy a temporary barrier or plug in the wellbore when required, while drilling, in order that a well situation can be appropriately evaluated and a decision made as to whether to take remedial action or permanently abandon the well.

Advantageously, the method can be used in open-hole as it does not require the drill-pipe to be anchored before the packer is set. The method also involves only a simple mechanically-activated valve which can easily be operated while drilling fluid is circulating as one or more balls can be dropped through the drill-pipe along with the drilling fluid. Furthermore, the use of drilling fluid (which will already be circulating in the drill-pipe as part of the drilling process) to hydraulically inflate the packer adds to the speed and efficiency of the method. In addition, the method can be implemented leaving the bore of the drill-pipe substantially open for access down-hole. This allows cables for communication or control to continue through the bore, unencumbered. Alternatively, cables can be built into the wall of the drill-pipe/tool in the region of the packer.

The method may further comprise the step of closing said one or more ports after the packer has been inflated. The step of closing said one or more ports may comprise use of a ball-activated valve. This may be a further ball-activated valve to the one mentioned previously or may be further use of the same ball-activated valve—in which case, the step may comprise increasing the pressure on the ball-activated valve. Thus, a single ball-activated valve may be provided for opening and closing the one or more ports to the packer.

The step of providing a deflated packer on a drill-pipe when drilling down-hole may comprise providing a tool on the drill-pipe that comprises an external body housing the one or more ports to the packer and supporting the packer; and an internal sleeve constituting the ball-activated valve. The sleeve may comprise a transverse valve seat with one or more holes configured for receipt of one or more balls and a longitudinal body having at least one aperture therein which is alignable with the one or more ports in the tool body for inflating the packer. The tool body may comprise one or more further ports located upstream of the packer to allow flow into the annulus above the packer.

The step of opening the one or more ports to the packer may comprise dropping one or more balls into the drill-pipe such that the one or more balls locate in the one or more holes in the valve seat. The method may then comprise increasing the pressure above the valve seat (e.g. by increasing the flow rate of drilling fluid into the drill-pipe or this may occur naturally due to the transverse holes in the sleeve being closed by the balls) to force the sleeve to move downstream within the tool body. When the at least one aperture in the sleeve body is aligned with the one or more ports in the tool body, drilling fluid circulating through the drill-pipe will be caused to flow into the packer to inflate the packer due to differential pressure. Once the packer is inflated, a pressure gradient above and below the valve seat may cause the sleeve to move further downstream within the tool body in order to close off the one or ports to the packer and/or to open the one or more further ports in the tool body, upstream of the packer, to allow flow into the annulus above the packer. Additionally or alternatively, movement of the sleeve to close the ports to the packer and open the ports to the annulus may be instigated by dropping one or more further balls. The one or more further balls may be of a different size to the initial one or more balls (e.g. the further ball/balls may be larger).

The method may further comprise measuring the pressure upstream and/or downstream of the packer. The pressure may be measured using known sensors.

Advantageously, the ball-activated valve may be actuated by a plurality of relatively small balls (i.e. when compared to the diameter of the drill-pipe) since these can be more easily circulated through the drill-pipe with the drilling fluid than a large ball. More specifically, the use of small balls will allow passage through tools such as a Measurement While Drilling (MWD) tool which may be located upstream of the packer.

In some embodiments, a measurement tool such as a MWD tool or a Logging While Drilling (LWD) tool may be located downstream of the packer. In which case, the one or more balls required to activate the ball-activated valve need not pass through the measurement tool and therefore the size of the one or more balls is not restricted accordingly (so, for example, a single large ball could be employed). However, in this case, it is desirable to provide a communication and/or control channel through the drill-pipe from the measurement tool to the surface. Accordingly, the present (packer) tool may comprise a communication and/or control channel there-through (e.g. through a bore of the tool or built into a wall of the tool).

In some embodiments, two or more packers may be employed and may be activated in accordance with the first aspect of the invention. In which case, a measurement tool (e.g. a MWD tool) may be provided between the two or more packers.

A one-way valve (e.g. 'float') may be provided to seal off the bore of the drill-pipe. The one-way valve may be located upstream of the packer.

The drill-pipe may be configured so that a top-section located upstream of the packer can be disconnected and pulled out of the borehole. Disconnection of the top-section may be achieved by further increasing the pressure in the drill-pipe or by use of a further ball-activated valve (e.g. using a larger ball). The bottom hole assembly (BHA) up to and including the packer may be left in the borehole and the well cemented shut.

It may be desirable to deflate or destroy the packer (e.g. once a well situation is under control). This may be performed by changing the pressure gradient in the region of the packer or by destroying the packer (e.g. by pulling or rotating the drill-string). Once the packer is deflated/destroyed drilling can continue and/or the drill-pipe (including the BHA) can be pulled to the surface.

The packer may be located a maximum of approximately 20 m from a drill bit.

According to a second aspect of the invention, there is provided an apparatus for sealing an annulus around a drill-pipe when drilling down-hole comprising:

- an external body supporting a packer and housing one or more ports thereto; and
- an internal sleeve comprising a transverse valve seat with one or more holes configured for receipt of one or more balls for ball-activation and a longitudinal body having at least one aperture therein which is alignable with the one or more ports in the external body for inflating the packer, when activated.

The external body may comprise one or more further ports located upstream of the packer to allow flow into the annulus above the packer.

The apparatus may comprise a communication and/or control channel there-through (e.g. through a bore of the external body or built into a wall of the external body).

The apparatus may comprise a one-way valve (e.g. 'float') to seal off a bore of the external body.

The apparatus may comprise a disconnection mechanism configured to disconnect the apparatus from the drill-pipe.

The apparatus of the present invention may be considered to be a drill-string packer sub or drill-pipe packer tool.

BRIEF DESCRIPTION OF THE DRAWINGS

By way of example, specific embodiments of the present invention will now be described with reference to the accompanying drawings, in which.

DETAILED DESCRIPTION OF CERTAIN EMBODIMENTS

Figure 3:
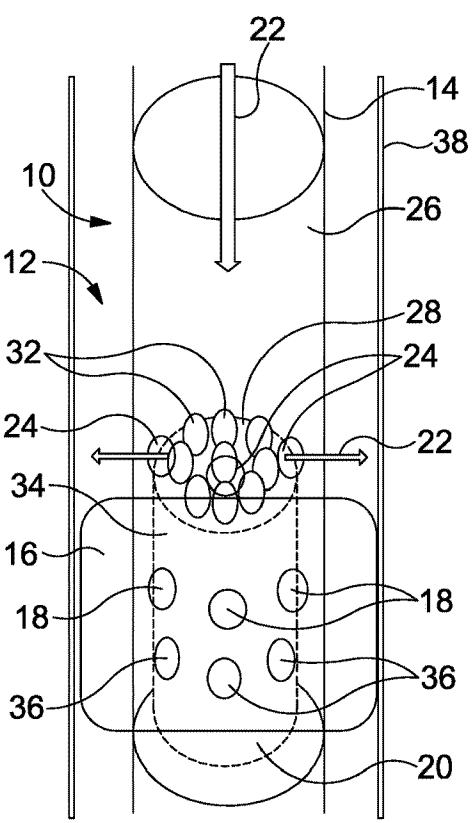
FIG. 3 shows the wellbore of FIG. 2 after the apparatus has been moved to a third position to seal the inflated packer.
Figure 2:
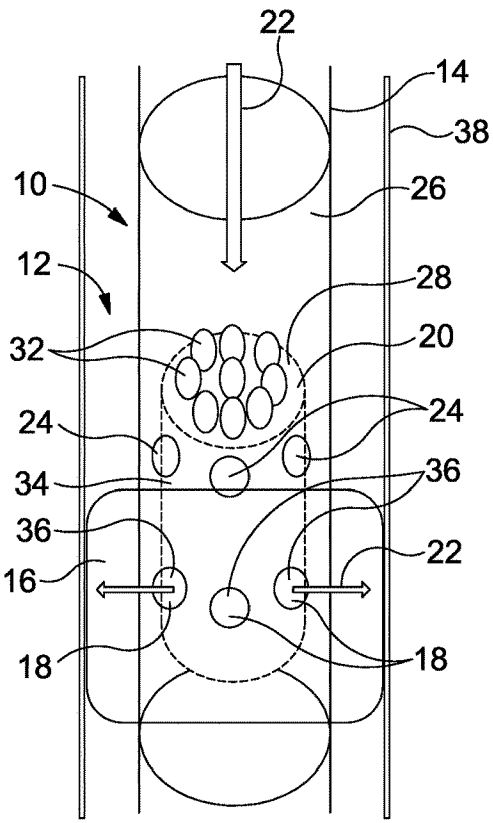
FIG. 2 shows the wellbore of FIG. 1 after the apparatus has been moved to a second position to inflate the packer.
Figure 1:
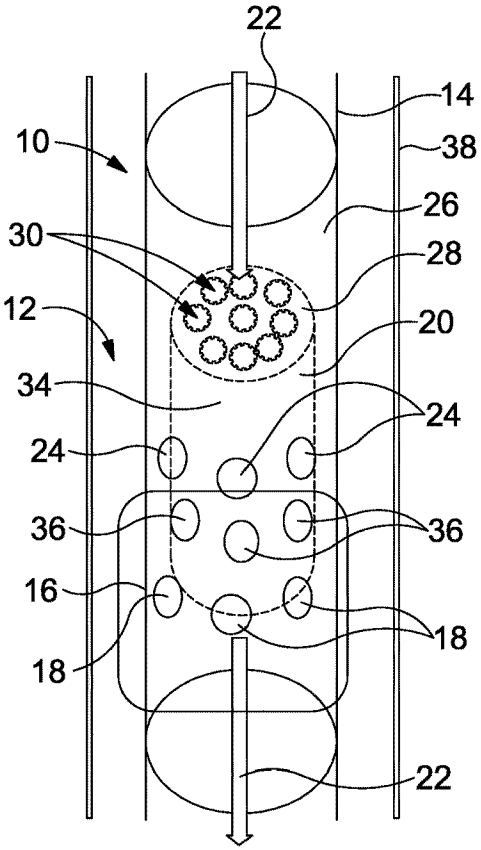
FIG. 1 shows a longitudinal part cross-sectional view of a wellbore provided with an apparatus for sealing an annulus around a drill-pipe when drilling down-hole, in accordance with a first embodiment of the invention, in a first position.

With reference to FIGS. 1, 2 and 3, there is illustrated a method and apparatus/tool 10 for sealing an annulus 12 around a drill-pipe 14 when drilling down-hole in accordance with a first embodiment of the present invention. The method comprises providing a deflated packer 16 on the drill-pipe 14 when drilling down-hole as illustrated in FIG. 1; opening ports 18 to the packer 16 using a ball-activated valve 20 and circulating drilling fluid 22 to inflate the packer 16 through the ports 18, to thereby form a seal in the annulus 12 around the drill-pipe 14, as shown in FIG. 2. The method further comprises closing the ports 18 to the packer 16 after it has been inflated and opening further ports 24 to allow flow into the annulus 12 above the packer 16, as shown in FIG. 3.

More specifically FIG. 1 shows the apparatus 10 in a first position in which the packer 16 is not deployed and drilling is in progress. The apparatus 10 comprises an external body 26 which supports the packer 16 and houses the packer ports 18 and annulus ports 24. The ball-activated valve 20 is constituted by an internal sleeve comprising a transverse valve seat 28 including holes 30 configured for receipt of balls 32 for ball-activation (see FIGS. 2 and 3). The valve 20 also comprises a longitudinal body 34 having apertures 36 therein that are alignable with the packer ports 18 in the external body 26 for inflating the packer 16, when activated.

In the position shown in FIG. 1, drilling fluid 22 (e.g. drilling mud) is permitted to circulate through the entire length of the drill pipe 14 as it is able to flow through the unobstructed holes 30 in the valve seat 28.

FIG. 2 shows the apparatus 10 in a second position after the balls 32 have been dropped to fill the holes 30 and the valve 20 has been moved downwardly, due to an increased pressure from above, until the apertures 36 are aligned with packer ports 18. The packer 16 is then inflated with drilling fluid 22 to expand the packer 16 such that it forms a seal between the drill-pipe 14 and the open-hole 38 of the wellbore. In this embodiment, the packer 16 may be inflated by existing drilling fluid 22 from the annulus or drill pipe 14 below the valve seat 28 or the pressure above the valve seat 28 could be increased so as to shear the valve seat 28 and re-gain circulation through the valve 20. Alternatively, the valve seat 28 could be provided at the base of the valve 20, below the apertures 36.

Once the packer 16 is inflated, the system is pressured up to shift the valve 20 to a lower position to close the packer ports 18 and thereby keep the packer 16 fully inflated as per FIG. 3 (i.e. since the apertures 36 are no longer aligned with the packer ports 18). In addition, this step moves the sleeve body 34 below the further ports 24 in the tool body 26 so that drilling fluid 22 can be circulated down the drill-pipe 14 and out into the annulus 12 above the packer 16. In this position, the borehole below the packer 16 is effectively sealed off as the packer 16 seals the annulus and the valve seat 28 seals the bore the drill-pipe 14.

Figure 4:
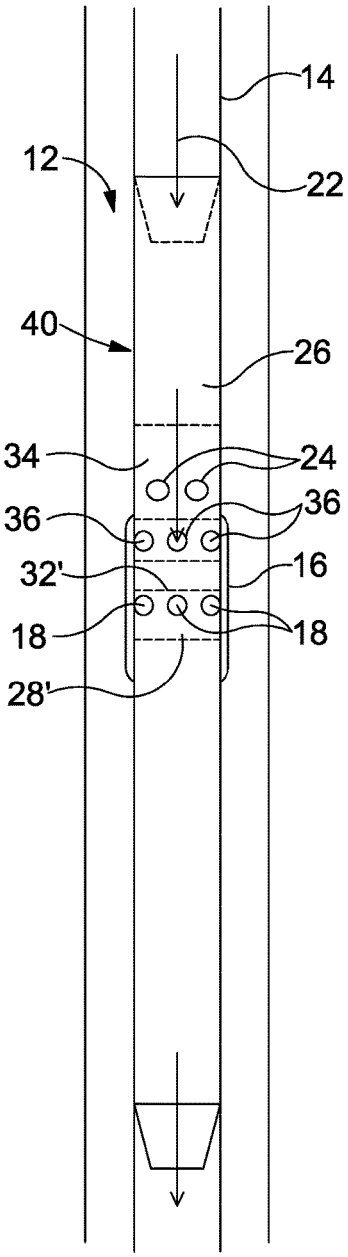
FIG. 4 shows a longitudinal part cross-sectional view of a wellbore provided with an apparatus for sealing an annulus around a drill-pipe when drilling down-hole, in accordance with a second embodiment of the invention, in a first position.
Figure 5:
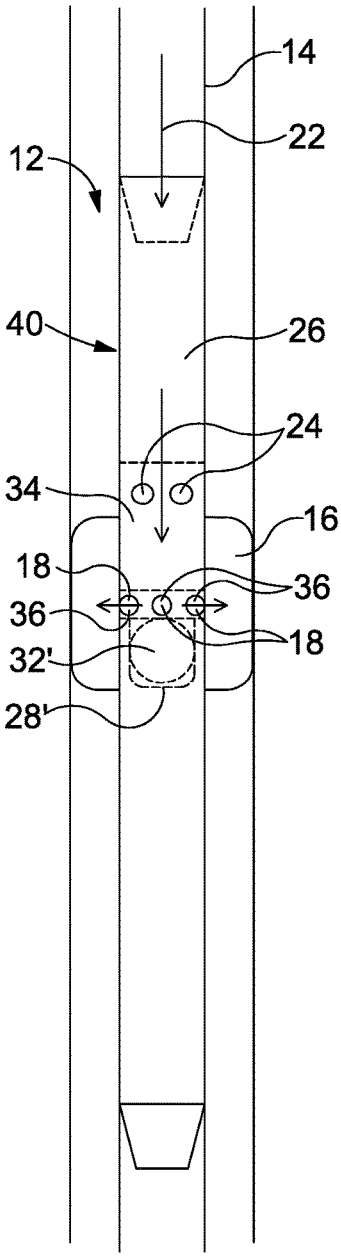
FIG. 5 shows the wellbore of FIG. 4 after the apparatus has been moved to a second position to inflate the packer.
Figure 6:
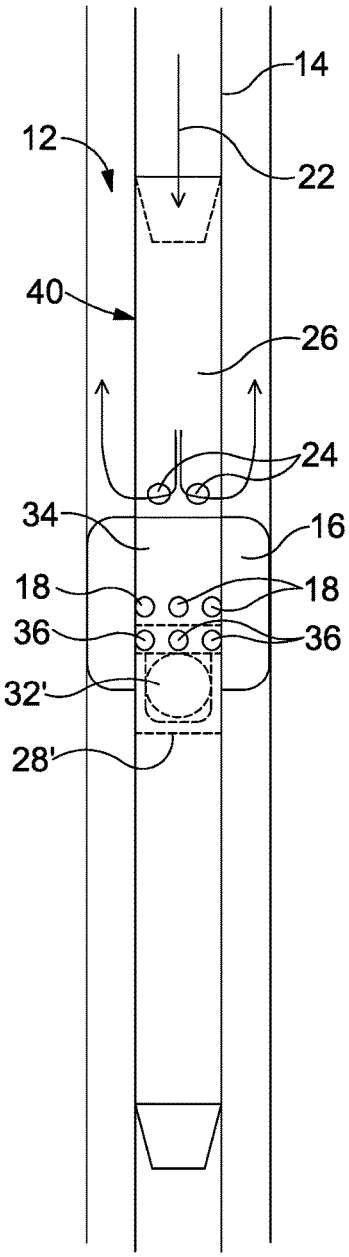
FIG. 6 shows the wellbore of FIG. 5 after the apparatus has been moved to a third position to seal the inflated packer.

FIGS. 4, 5 and 6 show a second embodiment of the present invention, which is similar to the above and so like reference numerals will be employed where appropriate. The main difference between the apparatus 40 of FIGS. 4 to 6 and that of FIGS. 1 to 3 is in the location and configuration of the valve seat 28'. In the second embodiment, the valve seat 28' is provided at the downstream end of the valve body 34 and is configured for receipt of a single large ball 32' (note the corresponding hole in the valve seat 28' is not shown in the Figures).

As above, the method illustrated in FIGS. 4 to 6 comprises providing a deflated packer 16 on the drill-pipe 14 when drilling down-hole as illustrated in FIG. 4. The ball 32' is then dropped into the valve seat 28' and after pressuring up the drill-pipe 14 above the valve seat 28', the ports 18 to the packer 16 are opened (by alignment with apertures 36 in the valve body 34). Drilling fluid 22 is then circulated to inflate the packer 16 through the apertures 36 and ports 18, to thereby form a seal in the annulus 12 around the drill-pipe 14, as shown in FIG. 5. The method further comprises closing the ports 18 to the packer 16 after it has been inflated (by moving the apertures 36 downwards) and opening further ports 24 in the tool body 26 to allow flow into the annulus 12 above the packer 16, as shown in FIG. 6.

Although not illustrated in either embodiment, if desired, the apparatus 10, 40 could be disconnected from the upper portion of the drill-pipe 14 to allow the upper portion to be removed and the wellbore to be cemented closed. Alternatively, the packer 16 could be destroyed or deflated after use so that drilling can continue. Furthermore, it will be understood that in embodiments of the invention, a control and/or communication channel may be provided through the apparatus 10, 40 (e.g. built into the wall of the external body 26) so that pressure can be measured below the packer and communicated to the surface.

The method and apparatus disclosed herein can further be described by the following numbered paragraphs:

1. A method of sealing an annulus around a drill-pipe when drilling down-hole, comprising:
   providing a deflated packer on a drill-pipe when drilling down-hole; opening one or more ports to said packer using a ball-activated valve; and
   circulating drilling fluid to inflate said packer through said one or more ports, to thereby form a seal in the annulus around the drill-pipe.
2. The method according to paragraph 1 further comprising the step of closing said one or more ports after the packer is inflated.
3. The method according to paragraph 2 wherein the step of closing said one or more ports comprises use of a ball-activated valve.
4. The method according to paragraph 3 wherein a single ball-activated valve is provided for opening and closing the one or more ports to said packer.
5. The method according to any preceding paragraph wherein the step of providing a deflated packer on a drill-pipe when drilling down-hole comprises providing a tool on the drill-pipe that comprises an external body housing the one or more ports to the packer and supporting the packer; and an internal sleeve constituting the ball-activated valve.
6. The method according to paragraph 5 wherein the sleeve comprises a transverse valve seat with one or more holes configured for receipt of one or more balls and a longitudinal body having at least one aperture therein which is alignable with the one or more ports in the tool body for inflating the packer.
7. The method according to paragraph 5 or 6 wherein the tool body comprises one or more further ports located upstream of the packer to allow flow into the annulus above the packer.
8. The method according to paragraph 6 or 7 comprising dropping one or more balls onto the valve seat and increasing the pressure above the valve seat to force the sleeve to move downstream within the tool body to open the one or more ports to the packer.
9. The method of paragraph 7 comprising using a pressure gradient above and below the valve seat, after the packer has been inflated, to cause the sleeve to move further downstream within the tool body in order to close off the one or ports to the packer and/or to open the one or more further ports in the tool body, upstream of the packer, to allow flow into the annulus above the packer.
10. The method according to any preceding paragraph further comprising measuring the pressure upstream and/or downstream of the packer.
11. The method according to any preceding paragraph wherein the ball-activated valve is actuated by a plurality of balls and each ball has a diameter of less than half of the diameter of the bore of the drill-pipe.
12. The method according to any preceding paragraph wherein a communication and/or control channel is provided through the drill-pipe from a measurement tool to the surface.
13. The method according to any preceding paragraph wherein two or more packers are employed and are activated in accordance with paragraph 1.
14. The method according to paragraph 13 wherein a measurement tool is provided between the two or more packers.
15. The method according to any preceding paragraph wherein a one-way valve is provided to seal off a bore of the drill-pipe, upstream of the packer.
16. The method according to any preceding paragraph comprising disconnecting and removing a top-section of the drill-pipe, the top-section being located upstream of the packer.
17. The method according to any preceding paragraph comprising deflating or destroying the packer after use.
18. An apparatus for sealing an annulus around a drill-pipe when drilling down-hole comprising:
   an external body supporting a packer and housing one or more ports thereto; and
   an internal sleeve comprising a transverse valve seat with one or more holes configured for receipt of one or more balls for ball-activation and a longitudinal body having at least one aperture therein which is alignable with the one or more ports in the external body for inflating the packer, when activated.
19. The apparatus according to paragraph 18 wherein the external body comprises one or more further ports located upstream of the packer to allow flow into the annulus above the packer.

20. The apparatus according to paragraph 18 or 19 comprising a communication and/or control channel there-through.

21. The apparatus according to any one of paragraphs 18 to 20 comprising a one-way valve to seal off a bore of the external body.

22. The apparatus according to any one of paragraphs 18 to 21 comprising a disconnection mechanism configured to disconnect the apparatus from the drill-pipe.

It will be appreciated by persons skilled in the art that various modifications may be made to the above-described embodiments without departing from the scope of the present invention, as defined by the claims. Furthermore, features described in relation to one embodiment may be mixed and matched with features described in relation to another embodiment.

The invention claimed is:

1. A method of sealing an annulus around a drill-pipe when drilling down-hole, comprising:

providing a deflated packer on an external body when drilling down-hole;

opening one or more ports to said packer using a ball-activated valve, wherein said opening comprises moving an internal sleeve of said ball-activated valve to a first position, such that one or more ports provided on the internal sleeve align with one or more ports provided on the external body;

circulating drilling fluid to inflate said packer through said one or more ports, to thereby form a seal in the annulus around the drill-pipe; and moving the internal sleeve to a second position below one or more further ports provided in the external body above the packer and circulating drilling fluid through said one or more further ports into the annulus above the packer.

2. The method according to claim 1, further comprising the step of closing said one or more ports after the packer is inflated.

3. The method according to claim 2, wherein the step of closing said one or more ports comprises use of a ball-activated valve.

4. The method according to claim 3, wherein a single ball-activated valve is provided for opening and closing the one or more ports to said packer.

5. The method according to claim 1, wherein the step of providing the deflated packer on the drill-pipe when drilling down-hole comprises providing a tool on the drill-pipe that comprises an external body housing the one or more ports to the packer and supporting the packer.

6. The method according to claim 5, wherein the internal sleeve comprises a transverse valve seat with one or more holes configured for receipt of one or more balls and a longitudinal body having at least one aperture therein which is alignable with the one or more ports in the tool body for inflating the packer.

7. The method according to claim 6, comprising dropping one or more balls onto the valve seat and increasing the pressure above the valve seat to force the internal sleeve to move downstream within the tool body to open the one or more ports to the packer.

8. The method of claim 1, comprising using a pressure gradient above and below the valve seat, after the packer has been inflated, to cause the internal sleeve to move further downstream within the tool body in order to close off the one or ports to the packer and/or to open the one or more further ports in the tool body, upstream of the packer, to allow flow into the annulus above the packer.

9. The method according to claim 1, further comprising measuring the pressure upstream and/or downstream of the packer.

10. The method according to claim 1, wherein the ball-activated valve is actuated by a plurality of balls and each ball has a diameter of less than half of the diameter of the bore of the drill-pipe.

11. The method according to claim 1, wherein a communication and/or control channel is provided through the drill-pipe from a measurement tool to the surface.

12. The method according to claim 1, wherein two or more packers are employed and are activated.

13. The method according to claim 12, wherein a measurement tool is provided between the two or more packers.

14. The method according to claim 1, wherein a one-way valve is provided to seal off a bore of the drill-pipe, upstream of the packer.

15. The method according to claim 1, comprising disconnecting and removing a top-section of the drill-pipe, the top-section being located upstream of the packer.

16. The method according to claim 1, comprising deflating or destroying the packer after use.

17. An apparatus for sealing an annulus around a drill-pipe when drilling down-hole, comprising:

an external body supporting a packer and housing one or more ports thereto; and an internal sleeve comprising a transverse valve seat with one or more holes configured for receipt of one or more balls for ball-activation and a longitudinal body having at least one aperture therein which, when the internal sleeve is in a first position, is alignable with the one or more ports in the external body for inflating the packer, when activated, wherein the external body houses one or more further ports above the packer for circulating drilling fluid into the annulus above the packer when an uppermost part of the internal sleeve is moved to a second position below said one or more further ports, and wherein a length of a portion of the longitudinal body above the at least one aperture is larger than a distance between the one or more ports in the external body and the one or more further ports in the external body above the packer.

18. The apparatus according to claim 17, comprising a communication and/or control channel there-through.

19. The apparatus according to claim 17, comprising a one-way valve to seal off a bore of the external body.

20. The apparatus according to claim 17, comprising a disconnection mechanism configured to disconnect the apparatus from the drill-pipe.

* * * * *